United States Patent [19]

Sciortino

[11] 4,456,149

[45] Jun. 26, 1984

[54] WATER DISPENSING SYSTEM

[75] Inventor: George J. Sciortino, New Orleans, La.

[73] Assignee: Venturon Corporation, Inc., Lafayette, La.

[21] Appl. No.: 313,300

[22] Filed: Oct. 21, 1981

[51] Int. Cl.[3] ..... B67D 5/08

[52] U.S. Cl. ..... 222/1; 222/54; 222/63; 222/643; 222/333

[58] Field of Search ..... 222/52, 54, 55, 61, 222/63, 64, 66, 333, 372, 380, 382, 400.8, 638, 642, 643, 641, 1; 318/472, 473; 361/25; 417/32

[56] References Cited

U.S. PATENT DOCUMENTS

| | | | |
|---|---|---|---|
| 2,940,395 | 6/1960 | Hill | 417/32 |
| 3,244,329 | 1/1966 | Cates | 222/333 X |
| 3,823,846 | 7/1974 | Probst | 222/641 |
| 4,030,634 | 6/1977 | Osborn | 222/64 X |
| 4,100,468 | 7/1978 | Slocum | 318/472 X |
| 4,153,181 | 5/1979 | Parker | 222/61 |
| 4,207,994 | 7/1980 | Offlee | 222/63 X |

FOREIGN PATENT DOCUMENTS

| | | | |
|---|---|---|---|
| 2046709 | 11/1980 | United Kingdom | 222/55 |

*Primary Examiner*—Joseph J. Rolla
*Assistant Examiner*—Kevin P. Shaver
*Attorney, Agent, or Firm*—Keaty & Keaty

[57] ABSTRACT

The invention relates to portable apparatuses for dispensing purified water from conventional five gallon water bottles directly into a spigot mounted on a sink or an ice maker of a refrigerator. The bottle of water does not have to be mounted on any known support or cabinet, but can remain in its upright position. The water is pumped directly from the bottle through a flexible tube upon drop in pressure in the transport line. A sensing mechanism detects this drop in pressure when the spigot is open and activates a motor which drives the pump. Second pressure switch de-activates the pump when the water runs out of the bottle to prevent overheating of the motor. The pump then has to be manually reset. A time release is provided when it is desired to connect the bottle to an ice maker, so that the pump continuously operates for several minutes to fill in the ice maker and then automatically stops.

5 Claims, 4 Drawing Figures

WATER DISPENSING SYSTEM

BACKGROUND OF THE INVENTION

1. Field of the Invention

The present invention relates to a system for dispensing water or the like. More particularly, the present invention relates to an automatic system whereby water is dispensed from preferably bottles and transported to spigots or other dispensing sources, such as an automatic ice maker.

2. General Background

Presently there is a ever increasing use of bottled water, particularly spring water or purified water, due to the ever increasing pollution of our lakes and rivers, and the distrust of the municipal water systems nationwide. In the present state of the art, bottled water is purchased in five gallon containers, which then must be raised onto a dispensing system such as a fountain or the like, which may have a spigot for dispensing a flow of water from the dispenser, the flow of water being transported to the spigot via gravity, with the flow opening of the water bottle positioned downward to allow flow into the dispensing system.

There are several obvious shortcomings to this particular manner. Initially, a five gallon bottle of water is very heavy, and cannot be lifted by elderly individuals, weakened individuals or children. Also, it becomes ever increasingly cumbersome and messy to attempt to position a bottle of water of that size upside down onto a dispenser, without spilling or in some instances dropping the entire bottle and causing either breakage or spillage throughout the area. Next, the flow of water out of the system, since the system depends solely on gravity for its source of power, is rather slight, and is not a flow which is amenable to receiving any type of quantity of water within a short amount of time. Also, since in fact this is a gravity flow system, all the components of the system must be placed in one particular area, and therefore, may be quite unsightly in ones home, etc. with all components in the same location. Therefore, the transport of the water takes an increased amount of time. Also, due to the fact that the water system must flow from one source, the availability of the water depends on that one spigot. Therefore, should one want to obtain water from more than one source, or wish to fill more than one container, it is required that he obtain the water from that one source and cannot depend on an alternative source, while the one source is being utilized.

Several patents discuss the alternative transport of bottled water from the bottle into a spigot, the most pertinent being as follows:

U.S. Pat. No. 4,174,743 issued to Benny, et al. entitled "System for Transferring Water" teaches the use of a pump system that is designed to draw water from a bottle or the like apparatus. In this parituclar patent, the system has been designed to transport water directly from the bottle into the water dispenser and fails to teach the use of the water in a spigot in the sink or in an ice maker.

U.S. Pat. No. 3,179,292 issued to W. B. Terry entitled "Water Cooler" teaches the use of a water cooler having a water cooling reservoir into which water to be cooled is pumped from containers supported by a support frame. This particular patent does not teach the use of a system for transporting the water from the bottle water container into the faucet on the sink or into an ice maker.

U.S. Pat. No. 3,825,154 issued to Jaeger entitled "Fluid Dispensing System" also teaches the use of a plurality of bottles from which water is pumped having an empty alarm and a pump activator and a counter for determining when the bottles may be empty. Also is provided a reserovir into which the water is pumped and the reservoir having a capillary outlet for dispensing the fluid therefrom. Again, this particular patent utilizes the force of gravity and the water is not pumped out of the faucet at the sink or is not able to be utilized in an ice maker.

U.S. Pat. No. 4,030,634 issued to Osborne entitled "Water Bottle Transfer Device" also teaches the use of a device for transferring water from a standard water bottle to a dispenser spot, without a need for lifting the bottle. There is also indicated a control sensor and an indicating means to indicate the pressure of the water flow. Like the previous patents, this particular patent also has a reservoir for the water and the water is dispensed into a typical water container for dispensing the water by use of gravity.

U.S. Pat. No. 4,153,181 issued to Parker, et al. entitled "Liquid Dispenser" also teaches the use of a unit for dispensing water from a bottle, including the various structures for conveying the water from the bottle into a dispensing unit and the use of a switching means and pump means in order to move the water therefrom. Like the previous patents, the water is delivered into a reservoir unit and is dispensed from a spigot on the unit. Also, there is no language in the patent which teaches the use of transferring the water to the sink, faucet or the the ice maker of an ice box.

It is evident from the patents cited, that none of the patents cited do teach the method and apparatus for moving water from a water bottle through a pump means into the a spigot mounted on the sink or into the ice maker, with an automatic shut-off when the water pressure has reached a certain level within the outlet line between the pump and the spigot or ice maker.

General Discussion of the Present Invention

The present invention would solve the problems and shortcomings in a simple and inexpensive straight forward manner. The present invention would provide for a system for dispensing water from water bottles with the use of a pump means, the pump means having a 110 voltage motor operated by a pressure switch mounted on the pump means which would normally closed contacts at zero pressure. When the water is admitted into the pump, and the pressure is developed to a certain point, the contacts are open and the pump is turned off. When the water that is pumped out of the pump is delivered through a line into a spigot mounted on the sink or into the ice maker of an ice box for making ice from the bottled water. When the water line is open, the pressure drops in the outlet line between the pump and the out source and the sensing mechanism activates the switch for turning the pump on again. A second switch with normally open contacts at zero pressure is mounted on the high pressure part of the pump to sense pressure and hold contacts closed to the pump motor when the water is in the line. When the water runs out of a particular bottle, and air is admitted to the high pressure side of the pump, the second pressure switch contacts open, disconnecting the power to the pump. The pump then has to be manually reset. This ability to shut the pump off through loss of pressure in the water line eliminates the need for additional sensing mechanisms in the bottle of water of pressure lines in the system. In the preferred embodiment, also provided is a cap means for mounting the line into the bottle, and a filter means on the end of the water line for filtering the water from the bottle into the transport line.

Therefore, it is an object of the present invention to provide a system for dispensing water from bottled water containers.

It is a further object of the present invention to provide a system and apparatus for dispensing water from bottled water containers into a spigot mounted on the sink, or in the alternative, to an ice maker line in an ice box or an ice box spiget.

It is still a further object of the present invention to provide a water dispensing system of bottled water which has an automatic shut-off valve of a pump when the pressure in the outlet line reaches a certain minimum level.

It is a further object of the present invention to provide a water dispensing system which has an automatic switching means for activating the pump when the water pressure is reduced to a certain level.

In order to accomplish the objects of the present invention, it is a feature of the present invention to provide a continuous line extending from a bottled water container to a spigot or the ice maker of an ice box having a pump means intermediate the bottled water and the dispensing source of the system.

It is an additional feature of the present invention to provide a water dispensing system having a pump means intermediate the bottled water and the dispensing spigot of the system.

It is still an additional feature of the present invention to provide a fluid transport line having a filter means at a first end and interconnecting into a pump means for moving the system through the fluid line into the spigot or ice maker of an ice box.

BRIEF DESCRIPTION OF THE DRAWING

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
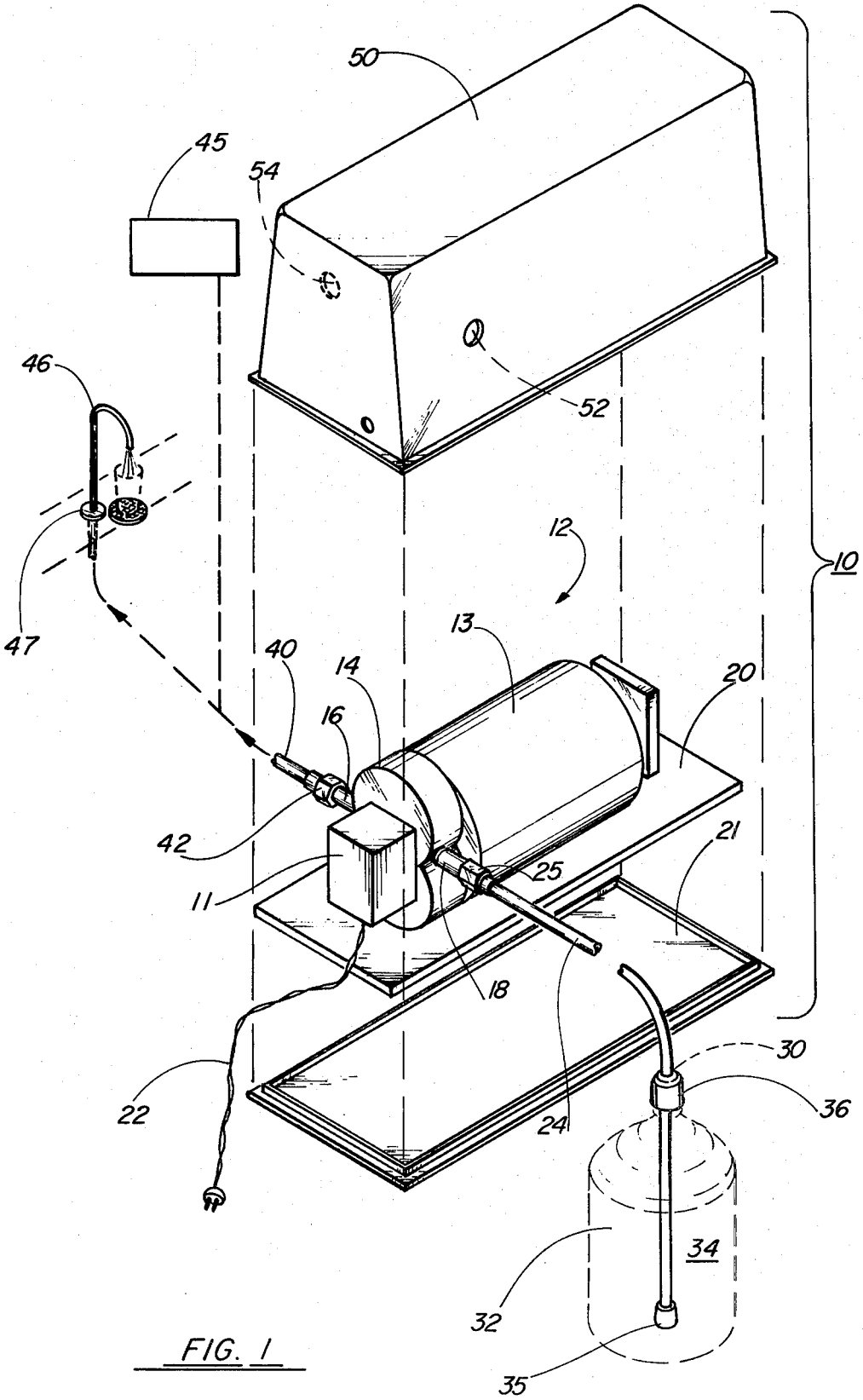
FIG. 1 is an exploded perspective view of the preferred embodiment of the apparatus of the present invention.

FIG. 1 best illustrates the preferred embodiment of the apparatus of the present invention generally designated by the numeral 10. In FIG. 1 there can be seen apparatus 10, which comprises a pump system 12, comprising electric motor 13 which would be a typical motor 110 volt motor having a pressure switch 11 with diaphragm and valve means 14, the typical type as taught in U.S. Pat. No. 4,081,621, with the pressure switch 11 and diaphragm means having an outlet port 16 and inlet port 18 for water flow therethrough upon activation of the pump 12. Pump system 12 would be mounted on a removable floor portion 20, which is substantially a rectangular mounting piece constructed of plastic or the like set up on base 21, and would be energized through electrical cord 22 leading into a typical 110 volt wall socket or the like. Extending from inlet port 18 would be first transport line 24, which would be comprised of typical flexible plastic or polyethelene line approximately ¼" in diameter extending at one point connectibly engaged through a quick release adapter 25 onto inlet port 18 at its first end and inserted into the top opening 30 of bottle 32 containing water 34 therein. Bottle 32 would be a typical 5 gallon water container. Contained on the second end of first transport line 24 would be filter means 35 which comprises a typical fine mesh filter for filtering out any impurities that may be contained in the water prior to the water entering into flow line 24 and also maintaining the end of line 24 out of contact with bottle 32, which may prevent flow. Also, flow line 24 would be adapted with an adjustable plastic cap 36 which would be of sufficient circumference to fit over the head portion of bottle 32, so that impurities and the like could not be dropped in to bottle 32 during use.

There is further illustrated in FIG. 1, the second delivery line 40, which extends from outlet port 16, which also would be adapted with a quick release adapter 42 and would extend into either a sink spigot 46, as illustrated mounting on a typical sink spout 47 or the like, or into the line of typical ice maker 45. LIke first line 24, this particular line would also be approximately ¼" in diameter, and constructed of plastic or polyethelene flexible material and would be of sufficient length to extend from the pump system 12 into the spigot 46 or the ice maker 45. For point of reference, with this particular pump, the pump 12 would preferably have from 40 to 45 pounds per square inch pumping capacity at the head of pump 12, and the transport line between the pump system 12 and bottle 32 may be up to 50' in length, with that desired pressure still obtainable. Therefore, the water bottles themselves may be exterior to the outlet of the water thus creating a more suitable atmosphere. Also, line 40 would also be connected onto spigot 46 or ice maker 45 via the use of a quick release adapter which would preferably be of plastic or like, or like fluid type means.

Further illustrated in FIG. 1 is cover means 50, which would be a typical plastic rectangular shaped cover for insertion on the top of motor 13, having ports 52 and 54 in its sides for alignment with outlet port 18 and exit port 16 respectively of pump 12. In the preferred embodiment, cover 50 would be attached to bottom portion 21 via a pair of screws or the like which would more firmly secure top cover 50 onto bottom portion 21.

Figure 2:
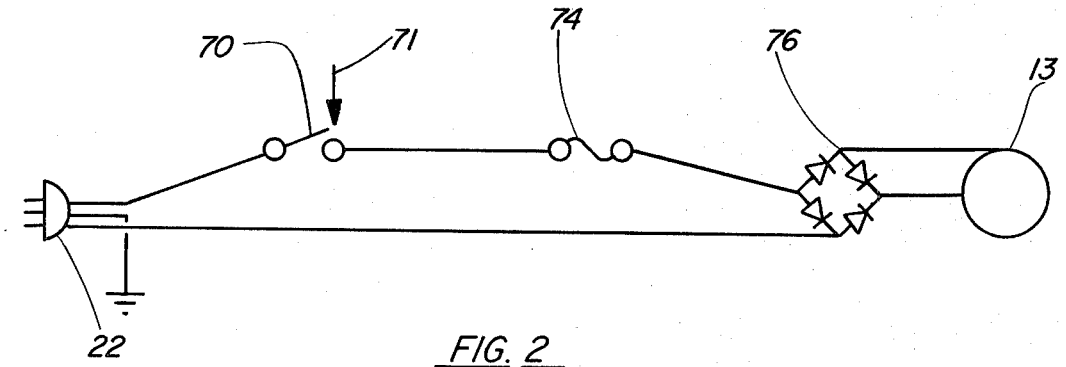
FIG. 2 is a schematic diagram of the wiring diagram of the typical motor in the apparatus of the present invention.
Figure 3:
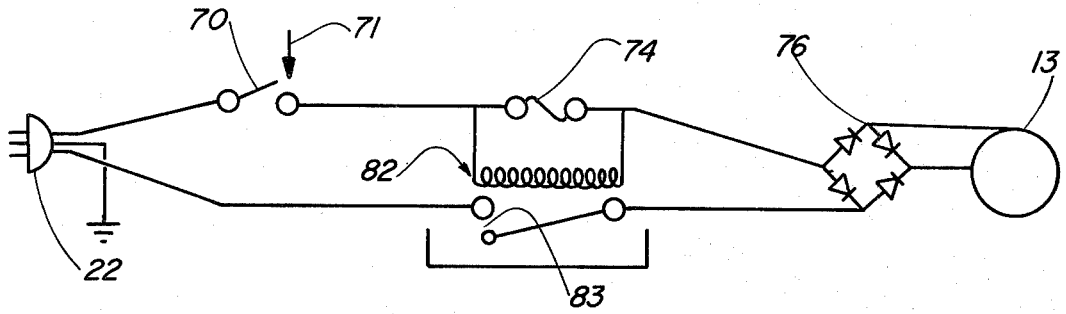
FIG. 3 is a schematic wiring diagram of the modified motor of the apparatus illustrating a latching relay modification of the present invention.
Figure 4:
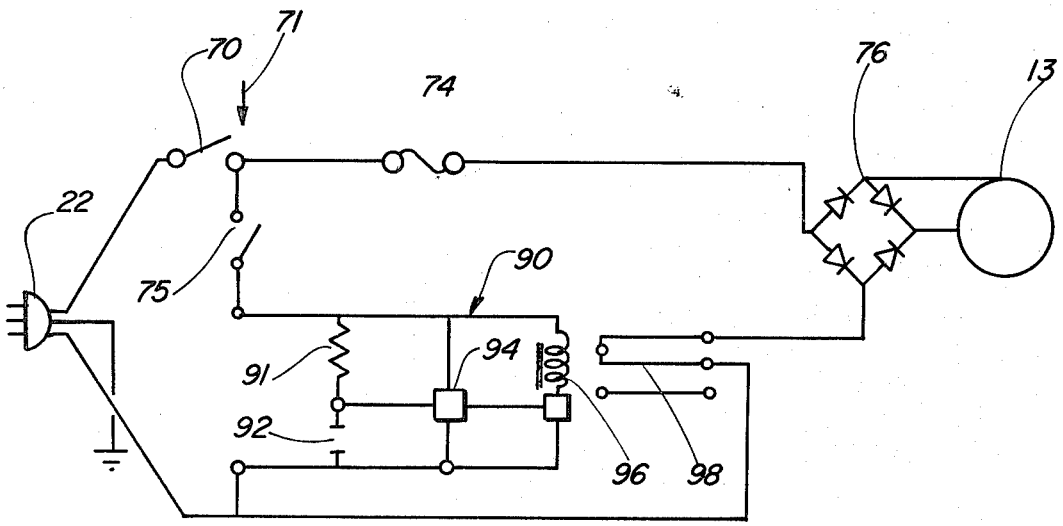
FIG. 4 is a schematic wiring diagram of the preferred embodiment of the apparatus of the present invention further illustrating the an adjustible timing circuit for allowing the pump to remain continuously on for a fixed period of time.

FIGS. 2 through 4 indicate a schematic electrical diagram involved in the water dispensing system of the apparatus of the present invention, with FIG. 4 illustrating the wiring diagram in the preferred embodiment of the apparatus. In FIG. 2 there can be seen a schematic wiring diagram of one embodiment of the apparatus, illustrating the automatic pressure switch and thermal overload for activating and de-activating motor 13 during the use of apparatus 10. As illustrated in FIG. 2, there can be seen normally closed switch 70 which would be held open due to pressurization of water contained in outlet line 40 between pump 14 and spigot 46 or ice maker 45. This pressurization is indicated by arrow 71 in FIG. 2. Upon release of pressurized fluid in line 40 by opening spigot 46 or ice maker valve 45, the contacts of normally closed pressure switch, which are being held open by pressure in line 40, would be placed in the closed position and motor 13 would then be activated.

As further illustrated in FIG. 2, thermal overload 74 which activates a typical thermal overload, and automatically shuts down motor 13 in the event that the motor became overloaded. Thermal overload 74 would have an automatic reset feature for automatically allowing motor 13 to reactivate upon reaching a less than thermal overload situation.

In FIG. 3 there is further illustrated an additional embodiment of the apparatus also indicating normally closed switch 70 which is a pressure switch normally open when pressure is placed upon it as indicated by arrow 71. There is also illustrated thermal overload 74 which would break contact when thermally overloaded, and would have an automatic reset feature. However, in this particular embodiment, there is further illustrating latching relay 82 which would be overriding thermal overload 74, and would allow the current to flow through latching relay 82 which would have normally closed contacts, and would have to be manually reset in order to reactivate motor 13. In this particular embodiment, therefore, when the current bypasses thermal overload 74 into latching relay 82, latching relay 82 would open contacts 83 and would thus shut off motor 13 and would have to be manually reset. Also illustrated in FIGS. 2 and 3 is bridge rectifier 76 for converting alternating current to direct current in motor 13. This latching relay mechanism 82 would thus prevent pump 12 from being reactivated by motor 13 upon the cooling of thermal overload 74. Since latching relay mechanism 82 must be manually reset, there is no chance that motor 13 would be reactivated upon cooling of thermal overload 74, and pump 12 running without in fact, there is, for example, no water left in the jar,s and the motor would simply reactivate itself again and again without really pumping any fluid through the apparatus.

FIG. 4 is a schematic diagram of the electrical circuitry in the preferred embodiment of the apparatus of the present invention. In FIG. 4 there is illustrated outlet plug 22, which is also illustrated in FIGS. 2 and 3, which is normally a 110 volt outlet plug for obtaining alternating current from a wall socket or the like. Further illustrated in FIG. 4 is normally closed pressure switch 70 which in the normal closed position allows the flow of current through the circuit. Further illustrated in sequence is thermal overload 74, which has been explained earlier, and which current would flow through and to a motor 13 for activation of motor 13 and activation of pump 12. In this particular embodiment, however, the latching relay mechanism 82 is removed and replaced with an adjustable timing circuit 90, which is set in parallel with thermal overload 74, thus, when current goes through thermal overload circuit 74 and motor 13 current also flows simultaneously through timing circuit 90, timing circuit 90 comprises an on/off switch 75 which allows current to flow to timing circuit 90 is coprised of adjustable resistor 91, and capicitor 92, and triggers circuit 94, and operating delay relay 96. In this particular embodiment, the relay would be set for five minutes. Therefore, after five minutes of continuous use of water, delay relay would open contacts 98, and thus the motor 13 would be shut off with open contacts 98 and thus motor 13 would have to be manually reset. Upon interruption of current through timing circuit 90, via pressure switch 70, delay relay 96 would reset itself, and contacts 98 would remain closed allowing current therethrough. This particular timing circuit is the type of circuit which is presently in use on the market, and is a typical timing circuit.

In the preferred embodiment, this particular pump 12 would move 2.4 gallons of water per minute or less depending upon the length of tubing used from a five gallon water bottle. In the event pump 12 would be adapted to more than one bottle, the water could be dispensed from a series of bottles with the pressure being sensed at the line 40 for activation of pump 12. The circuit timing is adjustible so that shorter periods of time could be set or the switch 75 could be open to the timing relay 90 to eliminate this feature. Pump 12 in the preferred embodiment would normally have the automatic cutoff feature, as illustrated.

Because many varying and different embodiments may be made within the scope of the inventive concept herein taught, and because many modifications may be made and the embodiments detailed in accordance with the descriptive requirement of the law, it is to be understood that the details herein are to be interpreted as illustrative and not in a limiting sense.

What is claimed as the invention is:

1. A portable water dispensing system, utilizing a water bottle in an upright position and at a distance from a dispensing port, which comprises:

a. a lightweight housing means placed between said water bottle and said dispensing port;

b. a pump means and a power means to drive said pump means mounted within said housing means;

c. a first fluid line passing through an aperture in said housing means connecting an inlet port of said pump means to at least one water bottle in an upright position for transferring water through said fluid line upon activation of said pump;

d. a second fluid line extending from an outlet port in said pump means through a second aperture in said housing means to the dispensing port for transferring water through said second fluid line into said dispensing port;

e. control means for automatically activating and deactivating said pump means mounted within said housing means, said control means comprising:

i. pressure switch means for automatically activating said pump means responsive to the drop of pressure in said second fluid line;

ii. thermal overload means for de-activating of said pump means when said pump means becomes overheated when the water bottle is empty;

iii. time delay means for de-activating of said pump means after a predetermined period of time so as to limit the maximum amount of water being pumped during a single demand activation of the pump means further comprising:

a. lockout means requiring manual reset for further pump operation when the time delay means have deactivated said pump.

2. A method of dispensing fluids from water bottles in an upright position and at a distance from a dispensing port, which comprises the following steps:

a. providing a lightweight housing means, positioned between said water bottle and said dispensing port;
b. providing a pum means and a motor means mounted within said housing means activated by an external power source;
c. providing first means for connecting an inlet port of said pump means with said water bottle, said means including a flexible transport means and means for attaching aid transport means to said pump and said water bottle;
d. providing second means for connecting an outlet port of said pump means with a dispensing port;
e. providing control means for automatic activating and de-activating of said pump means mounted within said housing means, said control means comprising:
   i. pressure switch means for automatically activating said pump means responsive to the drop of pressure in said second connecting means;
   ii. thermal overload means for de-activating of said pump means when said pump means becomes overheated;
   iii. time delay means for de-activating of said pump means after a predetermined period of time further comprising;
      a. lockout means requiring manual reset for further pump operation when the time delay means have deactivated said pump;
f. activating said pump means;
g. transporting water from said water bottle to said dispensing point, said water travelling through said pump means while said pump is activated;
h. mounting said second connecting means on a sink or an ice maker of an ice-box.

3. A portable water dispensing system for moving pressurized water from a soure of non-pressurized water positioned a distance from an outlet source, which comprises:

a. a source of fluid to be dispensed;
b. an outlet source for selectively allowing fluid out of said outlet;
c. pump means intermediate said fluid source and said outlet source;
d. power means for driving said pump means connecting adjacent said pump means;
e. a first line interconnecting an outlet port of said pump means to said fluid source, wherein the fluid from said fluid source would be moved through said fluid line upon the activation of said pump means;
f. a second fluid line extending from said outlet port in said pump means to said delivery port, for transporting fluid from said pump means to said delivery port;
g. pressure switch means responsive to the pressure in said second fluid line for allowing current to flow through said pressure switch means when said pressure is lost in said second fluid line;
h. thermal overload means for de-activating said pump when there is no water in said source of non-pressurized water and said pump becomes overheated;
i. timing delay means for de-activating said pump following continuous fluid flow through said pump during a predetermined period of time, further comprising:
   a. a lockout means requiring manual reset for further pump operation when the time delay means have deactivated said pump.

4. A method for dispensing fluids from a non-pressurized source of fluids to a dispensing source being positioned at a distance from each other, which comprises the following steps:

a. providing a lightweight housing means, and positioning it between said fluid source and said dispensing souce;
b. providing pump means and motor means mounted within said housing and activated by an external power source;
c. interconnecting said pump means with a source of fluids;
d. interconnecting said pump means to a dispensing source, with said pump means being substantially intermediate said source of fluid and said dispensing source;
e. activating said pump means;
f. transporting said fluid from said fluid containing source to said dispensing source, said fluid travelling through said pump means while said pump is activated;
g. mounting said dispensing source onto a sink or an ice maker or an ice box spigot;
h. providing a pressure switch means mounted within said housing responsive to the pressure in said line between said pump means and said dispensing source;
i. providing thermal overload means mounted within said housing means responsive to said heat accumulated in said pump during operation;
j. providing a timing circuit mounted within said housing means for de-activating said pump following a predetermined amount of continuous use time of said pump, further comprising providing lockout means requiring manual reset for further pump operation when the time delay means have deactivated said pump.

5. A portable, water dispensing system, utilizing a water bottle in an upright position and at distance, from a dispensing port, which compromises:

a. a lightweight housing means placed between said water bottle and said dispensing port;
b. a pump means and a power means to drive said pump means mounted within said housing means;
c. a first fluid line passing through an aperture in said housing means connecting an inlet port of said pump means to at least one water bottle in an upright position for transferring water through said fluid line upon activation of said pump means;
d. a second fluid line extending from from an outlet port in said pump means through a second aperture in said housing means to dispensing port means mounted on a sink for transferring water through said second fluid line into said dispensing port, so that the bottled water is used as a substitute for a supply of tap water;
e. control means for automatically activating said pump means mounted within said housing means, said control means further comprising:
   i. pressure switch means for automatically activating said pump means responsive to the drop of pressure in said second and third fluid lines;

ii. thermal overload means for de-activating of said pump means when said pump means becomes overheated as when the water bottle is empty;

iii. time delay means for de-activating of said pump means after a predetermined period of time so as to limit the maximum amount of water being pumped during a single activation of the pump means, further comprising lockout means requiring manual reset for further pump operation when the time delay means have deactivated said pump.

* * * * *